US008038271B2

(12) United States Patent
Kubo et al.

(10) Patent No.: US 8,038,271 B2
(45) Date of Patent: Oct. 18, 2011

(54) IMAGE FORMING APPARATUS INCLUDING RECORDING HEAD

(75) Inventors: Isamu Kubo, Sagamihara (JP); Yasuhiro Kawashima, Atsugi (JP); Kazuki Suzuki, Yokohama (JP); Masanori Tanaka, Zama (JP)

(73) Assignee: Ricoh Company, Ltd., Tokyo (JP)

( * ) Notice: Subject to any disclaimer, the term of this patent is extended or adjusted under 35 U.S.C. 154(b) by 532 days.

(21) Appl. No.: 12/260,566

(22) Filed: Oct. 29, 2008

(65) Prior Publication Data

US 2009/0122122 A1 May 14, 2009

(30) Foreign Application Priority Data

Nov. 14, 2007 (JP) ..... 2007-294992

(51) Int. Cl.
*B41J 2/175* (2006.01)
*B41J 2/17* (2006.01)

(52) U.S. Cl. ..... 347/85; 347/84

(58) Field of Classification Search ..... 347/84, 347/85, 86, 41, 37, 19, 7
See application file for complete search history.

(56) References Cited

U.S. PATENT DOCUMENTS

| | | | | |
|---|---|---|---|---|
| 6,796,627 | B2 * | 9/2004 | Kimura et al. | 347/85 |
| 7,077,495 | B2 | 7/2006 | Kawashima | |
| 7,419,241 | B2 | 9/2008 | Kawashima et al. | |
| 2003/0210309 | A1 * | 11/2003 | Kimura et al. | 347/85 |
| 2005/0104927 | A1 | 5/2005 | Kudoh et al. | |
| 2005/0146554 | A1 | 7/2005 | Asunuma et al. | |
| 2005/0194730 | A1 | 9/2005 | Nishida et al. | |
| 2006/0187504 | A1 | 8/2006 | Kawashima | |
| 2006/0209099 | A1 | 9/2006 | Kawashima | |
| 2006/0209116 | A1 | 9/2006 | Tanaka | |
| 2007/0171253 | A1 | 7/2007 | Kudoh et al. | |
| 2007/0236754 | A1 | 10/2007 | Tashiro et al. | |
| 2008/0231653 | A1 | 9/2008 | Kawashima et al. | |
| 2008/0273063 | A1 * | 11/2008 | Wouters et al. | 347/85 |

FOREIGN PATENT DOCUMENTS

| | | |
|---|---|---|
| JP | 60-42052 | 3/1985 |
| JP | 2002-316422 | 10/2002 |
| JP | 2007-15153 | 1/2007 |
| JP | 2007-125825 | 5/2007 |
| JP | 2007-136769 | 6/2007 |

OTHER PUBLICATIONS

Apr. 6, 2010 Chinese official action in connection with a counterpart Chinese patent application.

* cited by examiner

*Primary Examiner* — Kristal Feggins
(74) *Attorney, Agent, or Firm* — Cooper & Dunham LLP

(57) ABSTRACT

An image forming apparatus includes a carriage configured to movably scan, and including a recording head configured to discharge ink droplets and a sub tank configured to supply ink to the recording head; a main tank configured to supply the ink to the sub tank via a tube; a negative pressure detector configured to detect a state of a negative pressure in the sub tank; a count unit configured to count a number of scans conducted by the carriage; and a control unit configured to cause the negative pressure detector to detect the state of the negative pressure in the sub tank to return the negative pressure in the sub tank to a normal state based on a detection result obtained by the negative pressure detector when the number of scans carried out by the carriage as counted by the count unit reaches a predetermined scan count.

5 Claims, 10 Drawing Sheets

IMAGE FORMING APPARATUS INCLUDING RECORDING HEAD

BACKGROUND

1. Technical Field

This disclosure relates to an image forming apparatus including a recording head configured to discharge liquid droplets.

2. Description of the Background

One example of related-art image forming apparatuses having two or more of printing, copying, plotting, and facsimile functions includes an inkjet recording device employing a liquid discharge recording method. The inkjet recording device includes a recording head configured to discharge droplets of a recording liquid such as ink to form an image on a recording medium such as a sheet while the sheet is conveyed. It is to be noted that the sheet is not limited to paper but includes any medium, such as an OHP sheet, to which liquid droplets such as ink droplets can be adhered.

Examples of the inkjet recording device include a serial-type image forming apparatus, in which the recording head discharges liquid droplets while moving in a main scanning direction to form an image on the sheet, and a line-type image forming apparatus including a line-type recording head configured to discharge liquid droplets does so without moving to form an image on the sheet.

Image forming apparatuses hereinafter described form an image on a recording medium, such as paper, string, fiber, cloth, lather, metal, plastics, glass, wood, and ceramics by discharging liquid droplets onto the recording medium. In this specification, an image refers to both signifying images such as characters and figures, as well as non-signifying images such as patterns. Further, in this specification, ink includes any liquid, such as a recording liquid and a fixing solution, capable of forming an image on the recording medium.

In any such image forming apparatus that uses ink of whatever kind to print on a recording medium, leaks can be a problem. For example, Published unexamined Japanese Patent Application No. (hereinafter referred to as JP-A-) 2007-136769 discloses a serial-type image forming apparatus employing the liquid discharge recording method in which a sub tank such as a head tank and a buffer tank serving as a smaller-capacity liquid container for supplying the ink to the recording head is provided on a carriage including the recording head, and a larger-capacity main tank such as a main cartridge and an ink cartridge is provided on a main body of the image forming apparatus so that the ink is supplied from the main tank to the sub tank.

However, in the above-described serial-type image forming apparatus including the sub tank serving as an ink supply device, the ink may be inadvertently supplied from the main tank to the sub tank due to scanning movement of the carriage including the recording head and the sub tank when a seal provided by a supply pump configured to supply the ink from the main tank to the sub tank starts to deteriorate.

In general, negative pressure is generated in the sub tank in order to form ink meniscus in nozzles provided on the recording head for discharging ink droplets. However, when the ink is inadvertently supplied from the main tank to the sub tank as described above, the ink leaks out of the nozzles of the recording head due to a loss of the negative pressure in the sub tank.

To solve such a problem, JP-A-2002-316422 discloses an image forming apparatus in which a valve including a sealing unit, and a suction pump, are provided in a supply path between a main tank and a sub tank. The valve opens the supply path while the suction pump is in operation, and closes the supply path while the suction pump is not in operation.

However, a complicated configuration is required to include the valve including the sealing unit capable of completely closing the supply path between the main tank and the sub tank, resulting in higher costs.

Another approach is to improve seal performance of the suction pump so that the supply path can be completely closed while the suction pump, is not in operation. However, such a suction pump is required to have higher accuracy, also resulting in higher costs.

Alternatively, a negative pressure detector configured to constantly detect a state of the negative pressure in the sub tank may be provided in the sub tank so that the negative pressure is returned to a normal state when the negative pressure detector detects that the negative pressure in the sub tank is not in the normal state.

However, the above-described configuration cannot be applied to an image forming apparatus in which the negative pressure detector is not provided in the sub tank and the state of the negative pressure in the sub tank is detected at a predetermined position such as a home position of the carriage. Further, in the image forming apparatus in which the state of the negative pressure in the sub tank is detected at the predetermined position as described above, printing operations need to be stopped in order to detect the state of the negative pressure in the sub tank because the state of the negative pressure in the sub tank cannot be detected during the printing operations, causing a decrease in print speed.

SUMMARY

In one aspect of this disclosure, an image forming apparatus including a recording head is provided to prevent ink leakage from nozzles of the recording head due to an undesired state of negative pressure in a sub tank generated by inadvertent supply of ink to the sub tank. The image forming apparatus according to illustrative embodiments can prevent ink leakage from the nozzles of the recording head without a substantial decrease in print speed even when a state of the negative pressure in the sub tank cannot be detected during carriage operation.

In an illustrative embodiment, an image forming apparatus includes a carriage configured to movably scan and which includes a recording head configured to discharge ink droplets and a sub tank configured to supply ink to the recording head; a main tank configured to supply the ink to the sub tank via a tube; a negative pressure detector configured to detect a state of a negative pressure in the sub tank when the sub tank is at a predetermined position; a count unit configured to count a number of scans conducted by the carriage; and a control unit configured to cause the negative pressure detector to detect the state of the negative pressure in the sub tank to return the negative pressure in the sub tank to a normal state based on a detection result obtained by the negative pressure detector when the number of scans carried out by the carriage as counted by the count unit reaches a predetermined scan count.

Additional aspects, features and advantages of the present invention will be more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein like reference numerals designate identical or corresponding parts throughout the several views and wherein.

DETAILED DESCRIPTION OF THE ILLUSTRATIVE EMBODIMENTS

Figure 1:
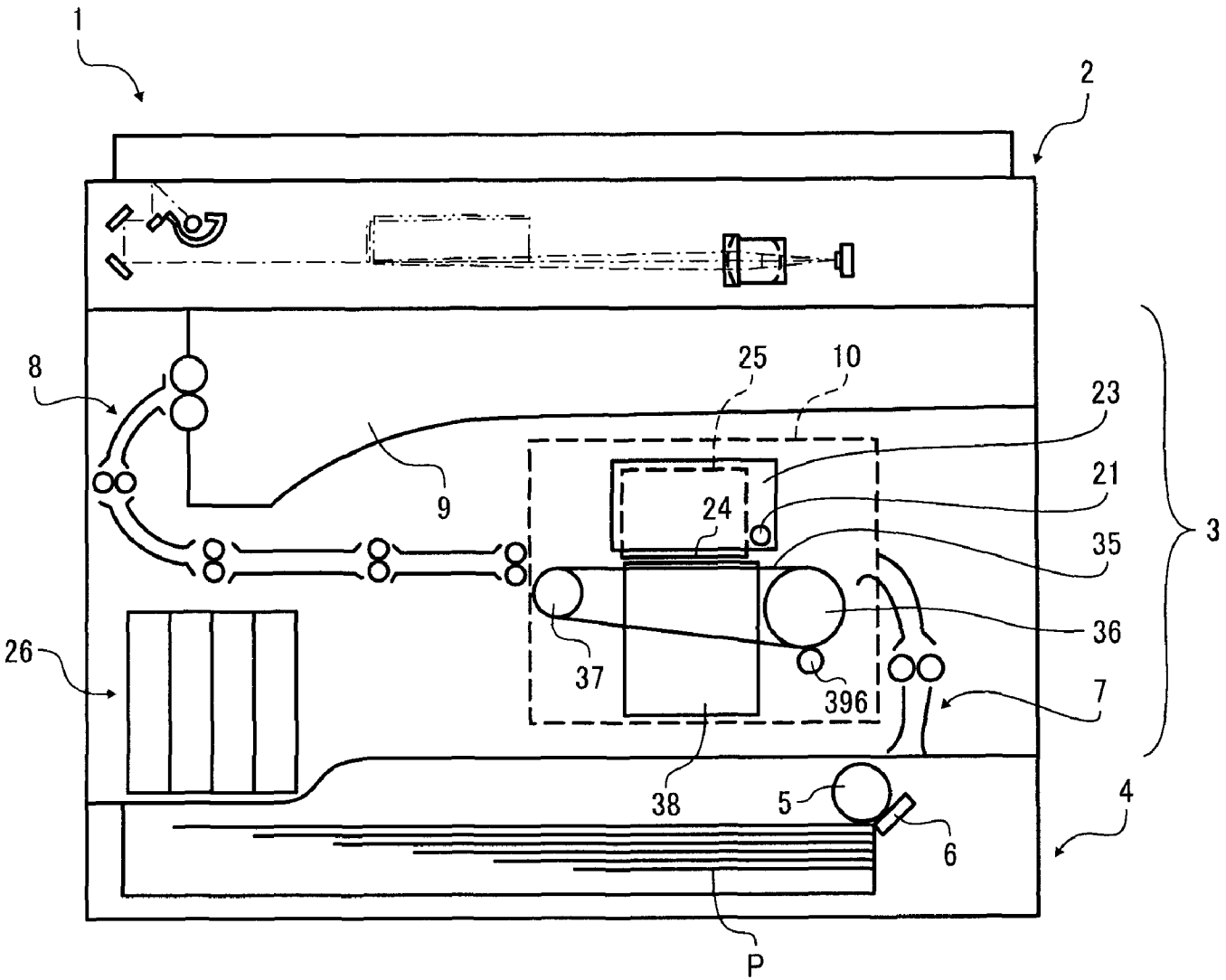
FIG. 1 is a schematic view illustrating an overall configuration of an image forming apparatus according to illustrative embodiments.

In describing illustrative embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Figure 2:
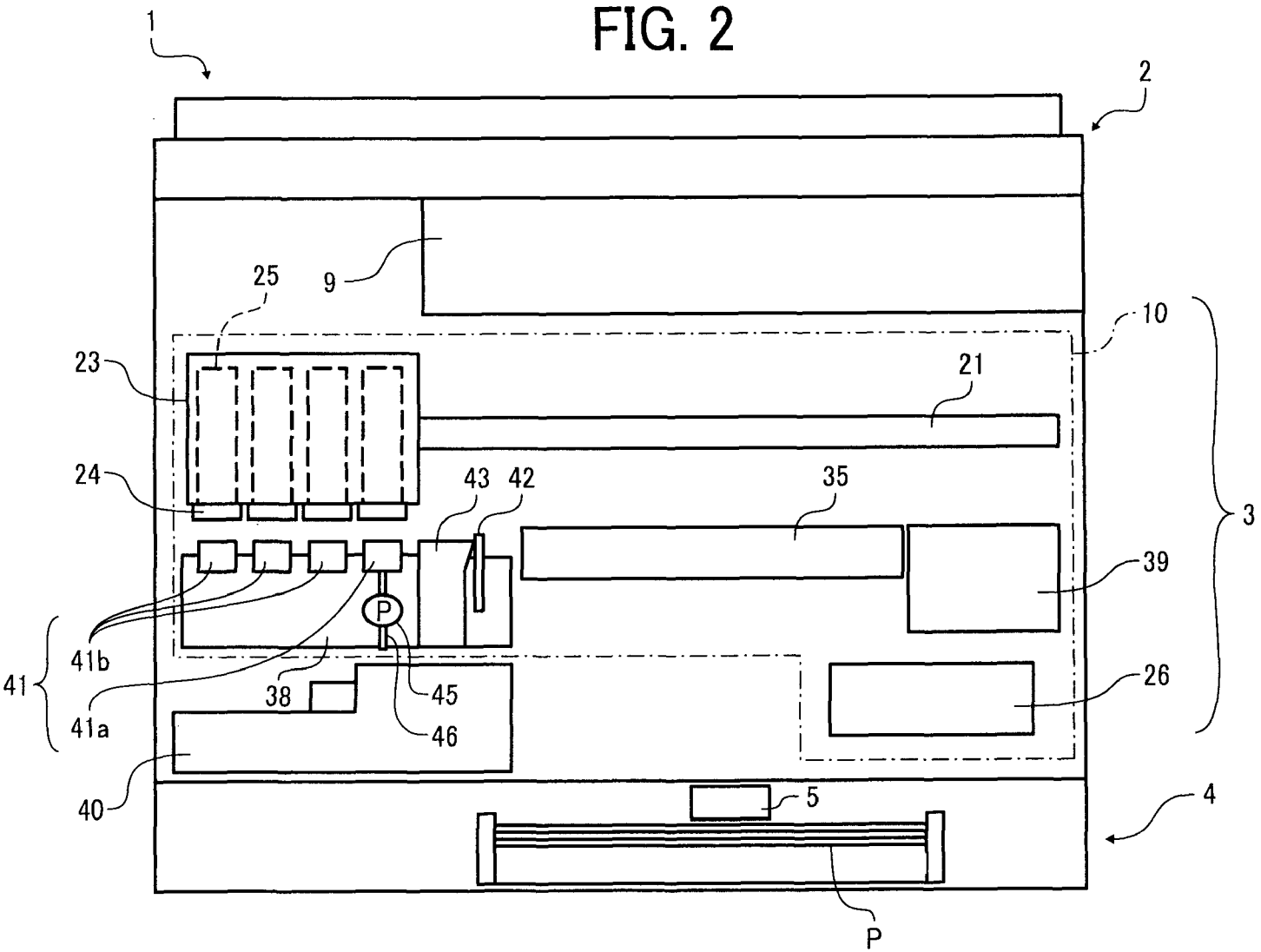
FIG. 2 is a vertical cross-sectional view of the image forming apparatus viewed from a left lateral side thereof.
Figure 3:
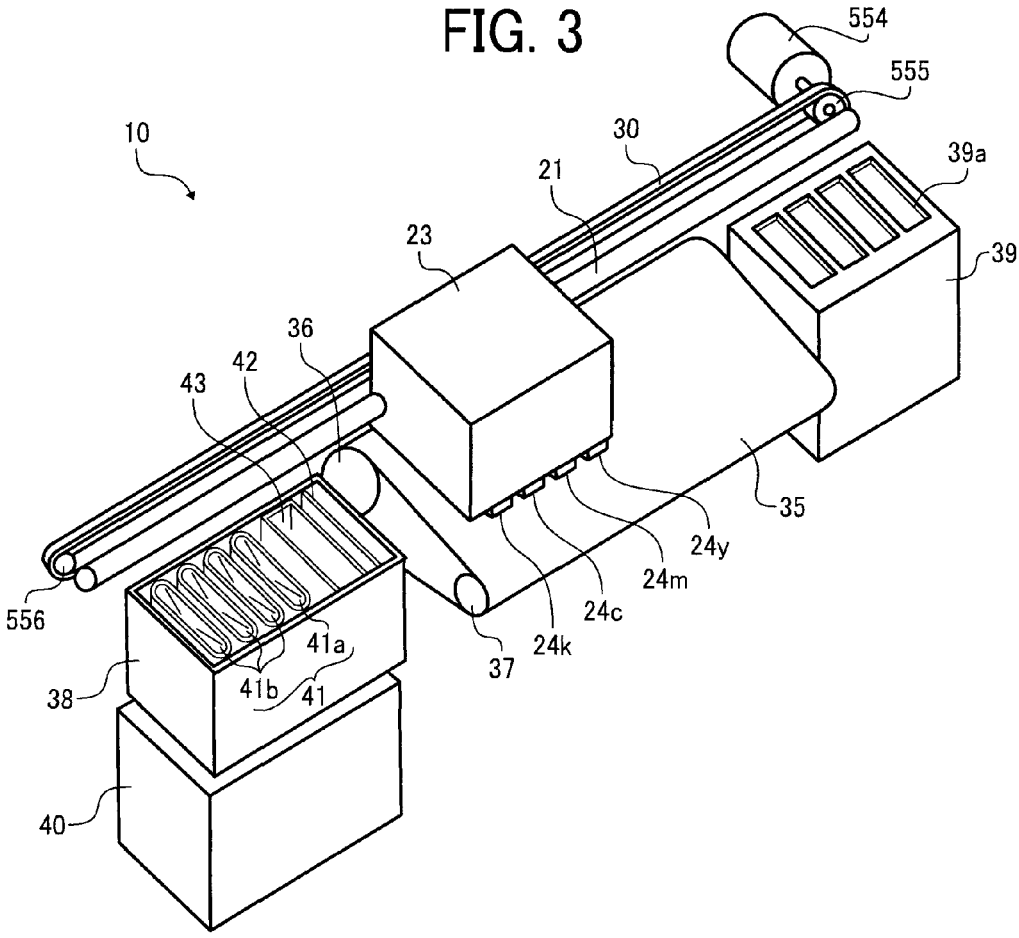
FIG. 3 is a perspective view illustrating a print unit of the image forming apparatus.
Figure 4:
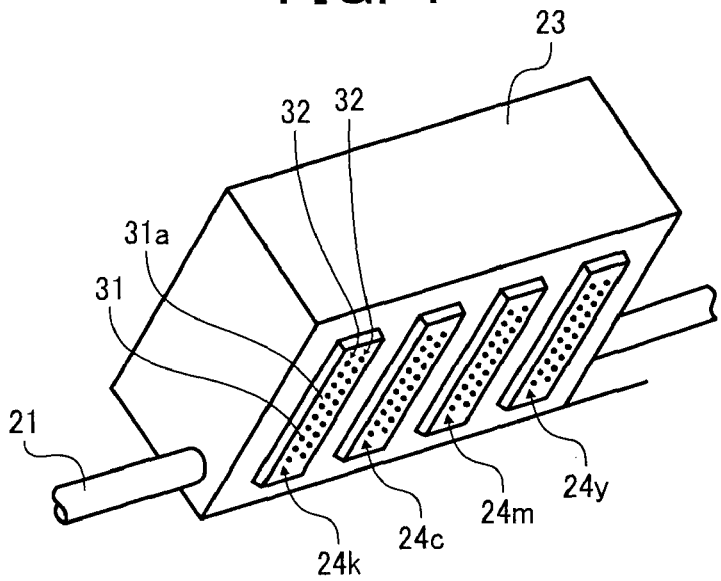
FIG. 4 is a perspective view illustrating a carriage viewed from a bottom surface thereof included in the image forming apparatus.

An example of an image forming apparatus according to illustrative embodiments is described in detail below with reference to FIGS. 1 through 4. FIG. 1 is a schematic view illustrating an overall configuration of an image forming apparatus 1 according to illustrative embodiments. FIG. 2 is a vertical cross-sectional view of the image forming apparatus 1 viewed from a left lateral side thereof. FIG. 3 is a perspective view illustrating a print unit 10 of the image forming apparatus 1. FIG. 4 is a perspective view illustrating a carriage 23 viewed from a bottom surface thereof included in the image forming apparatus 1.

The image forming apparatus 1 according to illustrative embodiments primarily includes an image reading unit 2, a recording unit 3, and a paper feed cassette 4. The image reading unit 2 includes a scanner configured to read an original document. The recording unit 3 is configured to form an image on a recording medium (hereinafter referred to as a sheet P). The paper feed cassette 4 is configured to feed the sheet P to the recording unit 3. The sheets P stored in the paper feed cassette 4 are separated by a paper feed roller 5 and a separation pad 6 and fed to the print unit 10 through a conveyance path 7. In the print unit 10, an image is formed on the sheet P. Thereafter, the sheet P having the image thereon passes through a discharge path 8, and is discharged to a paper discharge stack 9.

As illustrated in FIG. 3, in the print unit 10, the carriage 23 is movably supported by a guide rod 21 and a guide stay, not shown, in a main scanning direction. The carriage 23 is moved in the main scanning direction by driving a timing belt 30 stretched between a driving pulley 555 and a driven pulley 556 using a main scanning motor 554.

The carriage 23 includes recording heads 24*k*, 24*c*, 24*m*, and 24*y* (hereinafter collectively referred to as recording heads 24), and sub tanks 25. Each of the recording heads 24*k*, 24*c*, 24*m*, and 24*y* includes a liquid discharge head configured to discharge ink droplets of a specific color, specifically black (k), cyan (c), magenta (m), or yellow (y). Ink of each color is supplied to the relevant recording heads 24 from the relevant sub tanks 25.

As illustrated in FIG. 4, each of the recording heads 24 includes two nozzle arrays 32 in which multiple nozzles 31 for discharging the ink droplets are arranged in parallel rows. The recording head 24 is provided on the carriage 23 such that the two nozzle arrays 32 are positioned perpendicular to the main scanning direction, that is, a moving direction of the carriage 23, and a surface on which the two nozzle arrays 32 are provided (hereinafter referred to as a nozzle surface 31*a*) faces downward.

Ink cartridges 26 each serving as a main tank for supplying ink to the relevant sub tanks 25 corresponding to the recording heads 24 are detachably attached to the image forming apparatus 1. As described above, the ink is supplied from the ink cartridges 26 to the sub tanks 25.

Specific examples of the recording heads 24 include a piezoelectric recording head, a thermal recording head, and an electrostatic recording head. The piezoelectric recording head uses a piezoelectric element as an actuator for applying pressure to the ink in an ink path serving as a pressure chamber to change a capacity of the ink path by deforming vibration plates forming walls of the ink path to expel, or discharge, the ink droplets from the nozzle. The thermal recording head uses a heat-generation resistance body to generate bubbles in the ink by heating the ink in the ink path so that the ink droplets are discharged by pressure generated by the bubbles in the ink. In the electrostatic recording head, the vibration plates forming the walls of the ink path and an electrode are disposed opposite each other, and the vibration plates are deformed by an electrostatic force generated between the vibration plates and the electrode to change the capacity of the ink path and discharge the ink droplets.

A seamless conveyance belt 35 configured to electrostatically convey the sheet P is provided below the carriage 23. The conveyance belt 35 is stretched between a driving roller 36 and a driven roller 37, and rotated to convey the sheet P in a direction perpendicular to the main scanning direction. A charging roller 396 configured to charge the conveyance belt 35 is provided so as to rotate along with the rotation of the conveyance belt 35.

As illustrated in FIGS. 2 and 3, a maintenance/recovery mechanism 38 configured to perform maintenance and recovery operations on the multiple nozzles 31 of the recording heads 24 is provided at a non-printing area located at an end of the main scanning direction of the carriage 23. An ink receiver 39 configured to receive ink droplets not used for image formation discharged from the multiple nozzles 31 during an idle state is provided at a non-printing area located at the other end of the main scanning direction of the carriage 23. The ink receiver 39 includes four openings 39*a*.

The maintenance/recovery mechanism 38 includes multiple cap members 41, a wiper blade 42, and an ink collecting unit 43. The multiple cap members 41 include a suction cap 41*a* and three moisture-retention caps 41*b* to cap the nozzle surfaces 31*a* of each of the recording heads 24. The wiper blade 42 is configured to wipe the nozzle surfaces 31*a* of each of the recording heads 24. The suction cap 41*a* is connected to a suction pump 45 including a tube pump. A waste ink container 40 configured to store waste ink is provided below the maintenance/recovery mechanism 38. The waste ink collected by the suction pump 45 passes through a discharge tube 46 to be discharged to the waste ink container 40.

Figure 5:
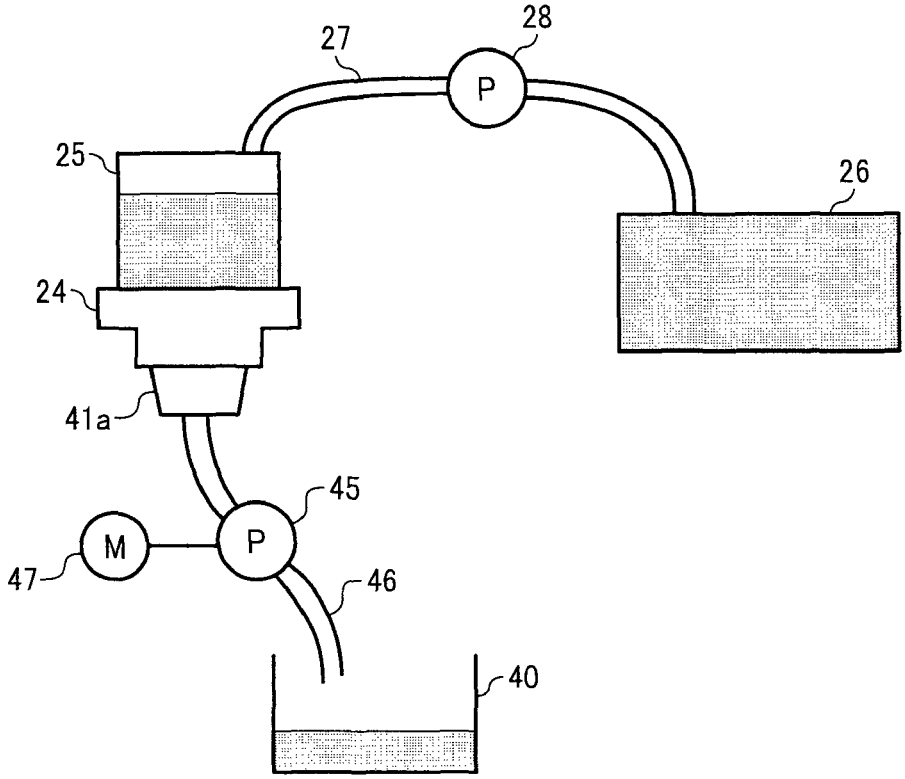
FIG. 5 is a schematic view illustrating an ink supply system and a maintenance/recovery system of the image forming apparatus according to a first illustrative embodiment.

A description is now given of an ink supply system and a maintenance/recovery system of the image forming apparatus 1 according to a first illustrative embodiment with reference to FIG. 5. FIG. 5 is a schematic view illustrating the ink supply system and the maintenance/recovery system of the image forming apparatus 1 according to the first illustrative embodiment.

Referring to FIG. 5, in the ink supply system, a supply pump 28 including a piston pump or the like is driven to supply the ink from the ink cartridge 26 to the sub tank 25 through the supply tube 27. Thereafter, the ink is supplied from the sub tank 25 to the recording head 24 to discharge the ink droplets.

The maintenance/recovery mechanism 38 is operated at a predetermined timing or when the ink droplets are not properly discharged from the multiple nozzles 31 due to an increase in viscosity in the ink in the multiple nozzles 31. During the operations of the maintenance/recovery mechanism 38, the suction pump 45 rotated by a maintenance/recovery motor 47 generates negative pressure in an inner space formed by the nozzle surface 31*a* of the recording head 24 and the suction cap 41*a* when the nozzle surface 31*a* is sealed by the suction cap 41*a*, so that the ink droplets are discharged from the multiple nozzles 31. The ink droplets discharged from the multiple nozzles 31 at this time are discharged to the waste ink container 40 from the suction pump 45 as waste ink. The maintenance/recovery motor 47 is configured to move the cap 41 up and down and drive the suction pump 45.

Figure 6A:
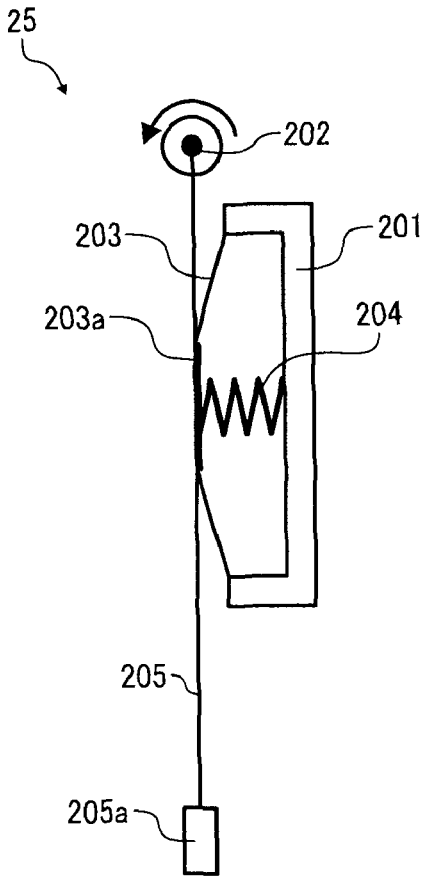
FIGS. 6A and 6B are cross-sectional views of an example of a sub tank along a main scanning direction.
Figure 6B:
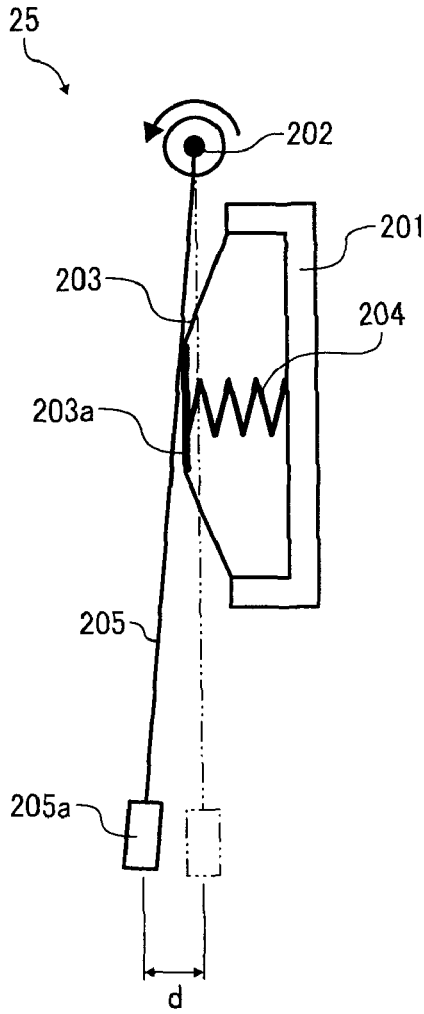

An example of the sub tank 25 is described in detail below with reference to FIGS. 6A and 6B. FIGS. 6A and 6B are cross-sectional views of an example of the sub tank 25 along the main scanning direction.

The sub tank 25 includes a tank case 201 having an opening on a lateral side thereof and configured to store the ink. The opening of the tank case 201 is sealed by a flexible film 203. The flexible film 203 is pressed outward by a spring 204 serving as an elastic member provided in the tank case 201. Accordingly, negative pressure is generated in the tank case 201 as an amount of ink in the tank case 201 decreases.

Further, a detection filler 205 serving as a negative pressure detection lever is provided outside the tank case 201. An edge of the detection filler 205 is hingedly supported by a support shaft 202, and the detection filler 205 is pressed against an expanded portion 203*a* of the flexible film 203 by a spring, not shown. As the amount of the ink in the sub tank 25 changes, a state of the flexible film 203 pressed outward by the spring 204 also changes. As a result, a leading edge detection piece 205*a* of the detection filler 205 is moved a certain amount in the main scanning direction as indicated by a double-headed arrow d in FIG. 6B.

In other words, the detection filler 205 functions as a movable negative pressure detector. Therefore, the state of the negative pressure and the amount of the ink in the sub tank 25 are obtained by detecting a position of the leading edge detection piece 205*a* of the detection filler 205 at a predetermined position.

Figure 7:
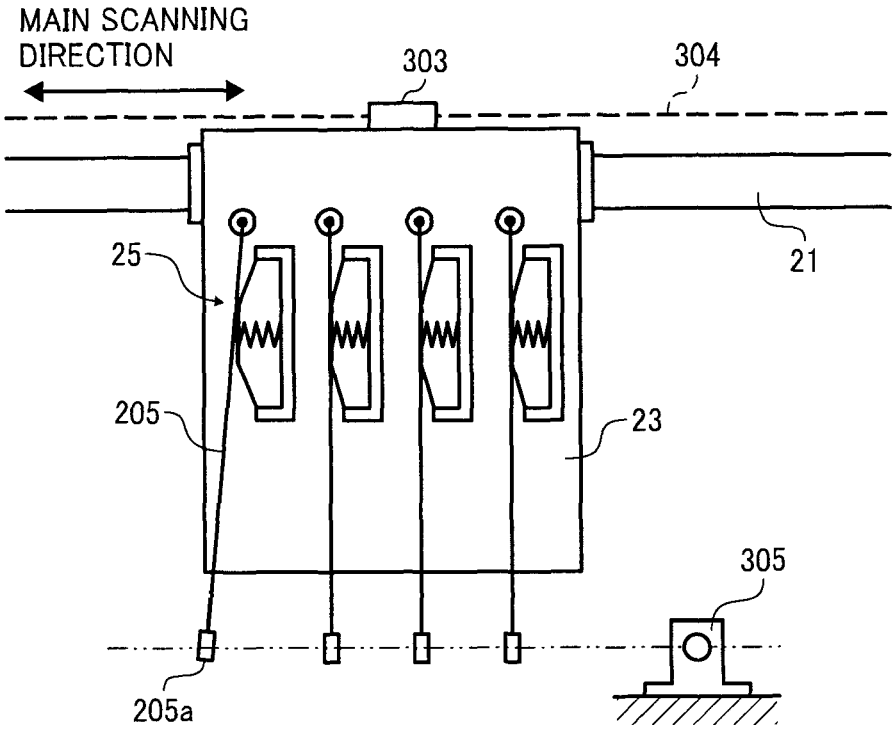
FIG. 7 is a plan view of a negative pressure detector.

For example, as illustrated in FIG. 7, the image forming apparatus 1 may further include a filler detector 305 also serving as a negative pressure detector including a transmissive optical sensor. The filler detector 305 is provided at a position through which the leading edge detection piece 205*a* of the detection filler 205 of the sub tank 25 passes when the carriage 203 is moved in the main scanning direction. The position of the carriage 23 in the main scanning direction is detected by reading an encoder scale 304 provided along the main scanning direction of the carriage 23 using an encoder sensor 303.

The above-described configuration makes it possible to detect the amount of the ink remaining in the sub tank 25 based on the position of the leading edge detection piece 205*a* of the detection filler 205 in the main scanning direction detected by the filler detector 305. Further, that the negative pressure in the sub tank 25 is not in a normal state can be detected when an amount by which the position of the leading edge detection piece 205*a* shifts as detected by the filler detector 305 exceeds a predetermined amount.

Figure 8:
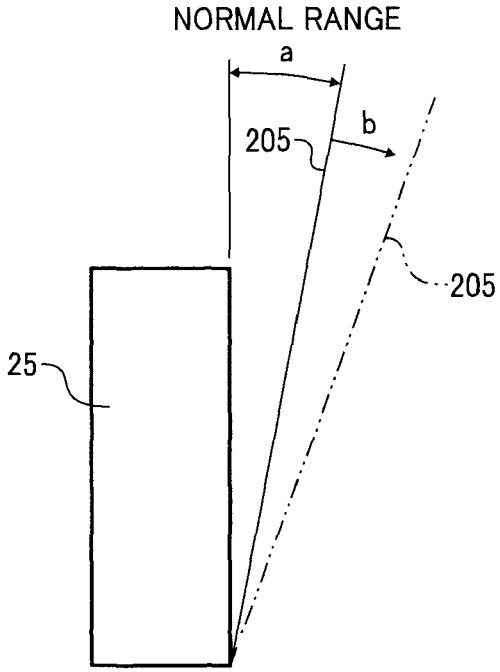
FIG. 8 is a view illustrating changes in a position of a detection filler between when a negative pressure in the sub tank is and is not in a normal state.

Specifically, when the negative pressure in the sub tank 25 is in the normal state, the position of the detection filler 205 is moved within a normal range indicated by a double-headed arrow a in FIG. 8. By contrast, for example, when positive pressure is generated in the sub tank 25 due to excessive supply of ink to the sub tank 25, the flexible film 203 bulges outward, and consequently, the detection filler 205 is moved beyond the normal range in a direction indicated by an arrow b in FIG. 8. As a result, in a case in which the detection filler 205 is not detected by the filler detector 305 even when the sub tank 25 is moved by the predetermined amount, it can be detected that the negative pressure in the sub tank 25 is not in the normal state.

Figure 9:
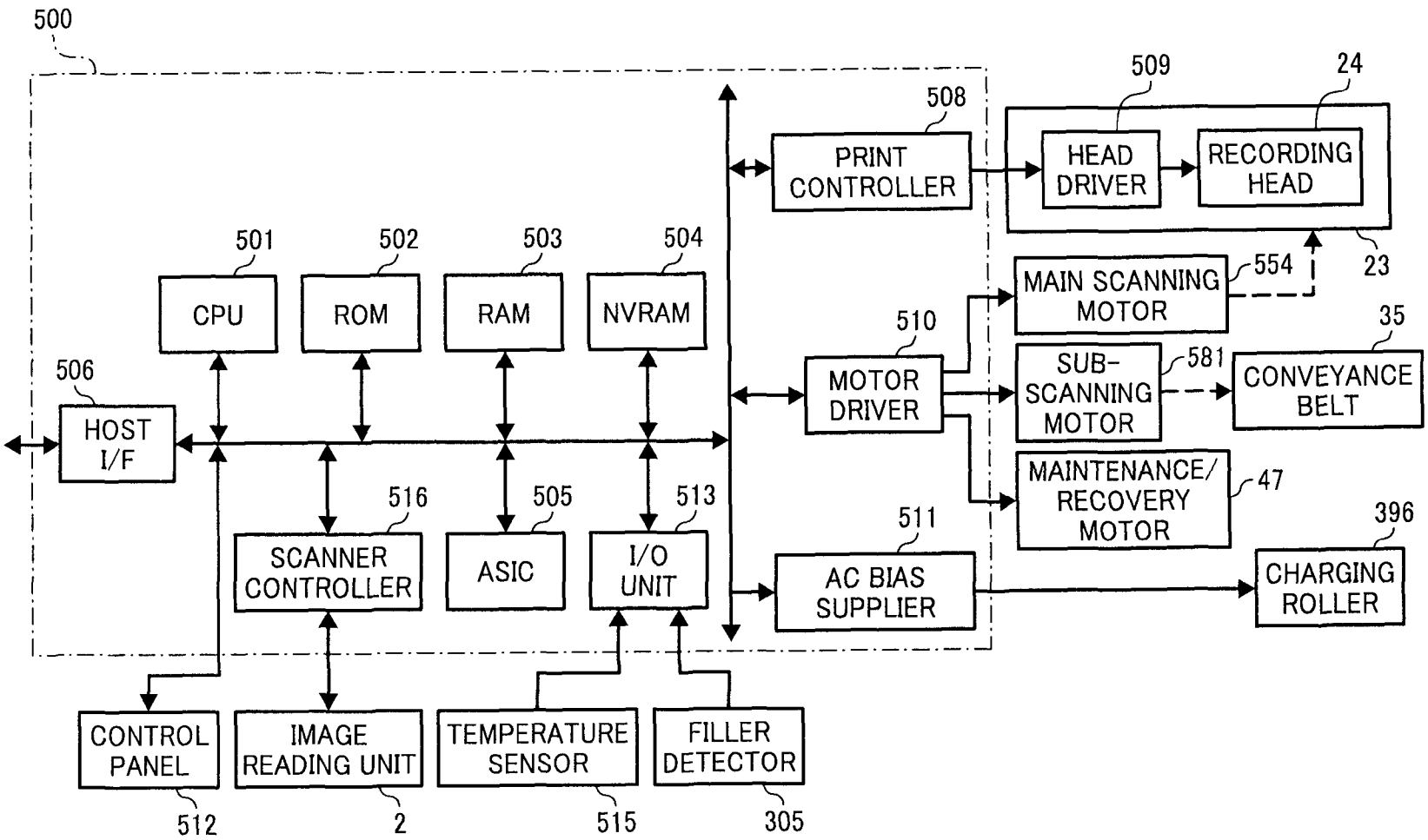
FIG. 9 is a block diagram of a control unit of the image forming apparatus.

A description is now given of a control unit 500 of the image forming apparatus 1 with reference to FIG. 9. FIG. 9 is a block diagram of the control unit 500.

The control unit 500 includes a CPU 501, a ROM 502, a RAM 503, an NVRAM 504, an ASIC 505, a print controller 508, a motor driver 510, and an AC bias supplier 511. The CPU 501 is configured to control the image forming apparatus 1 according to illustrative embodiments. The ROM 502 is configured to store programs performed by the CPU 501 and fixed data. RAM 503 is configured to temporarily store image data and so forth. The NVRAM 504 includes a rewritable nonvolatile memory configured to store data while the image forming apparatus 1 is tuned off. The ASIC 505 processes signals for image data, image data to be sorted, and input/output signals for controlling the image forming apparatus 1.

The print controller 508 includes a data transfer unit and a drive signal generation unit each configured to drive and control the recording heads 24. The print controller 508 drives and controls the recording heads 24 via a head driver 509 configured to drive the recording heads 24 provided on the carriage 23. The motor driver 510 drives a main scanning motor 554 configured to move the carriage 23, a sub-scanning motor 581 configured to rotate the conveyance belt 35, and the maintenance/recovery motor 47 of the maintenance/recovery mechanism 38. The AC bias supplier 511 drives the maintenance/recovery motor 47 of the maintenance/recovery mechanism 38 to supply an AC bias to the charging roller 396.

A control panel 512 configured to input and display data necessary for the operation of the image forming apparatus 1 is connected to the control unit 500.

The control unit 500 further includes a host I/F 506 configured to transmit/receive data and signals to/from a host device. The host I/F 506 receives data sent from a data processing device such as a personal computer, an image reading device such as an image scanner, a photographing device such as a digital camera, and so forth, via a cable or a network.

The CPU 501 of the control unit 500 reads out print data in a reception buffer included in the host I/F 506 to analyze the print data. The ASIC 505 performs image processing and sorting on the print data thus read out under the control of the CPU 501 as needed. The print controller 508 transfers image data processed by the ASIC 505 to the head driver 509 under the control of the CPU 501.

Further, the print controller 508 outputs a transfer clock signal, a latch signal, and a control signal necessary for transferring the image data and confirming the transfer of the image data to the head driver 509 while transferring the image data as serial data to the head driver 509. These processes are performed by a drive signal generator included in the print controller 508. The drive signal generator includes a D/A converter, a voltage amplifier, a current amplifier, and so forth. The drive signal generator outputs a drive signal including one or more drive pulses to the head driver 509. The D/A converter included in the drive signal generator performs digital/analog conversion on pattern data of drive pulses stored in the ROM 502.

In order to drive the recording heads 24, the head driver 509 selectively applies the drive pulses included in the drive signal sent from the print controller 508 to a drive element, such as a piezoelectric element, which generates energy for discharging ink droplets from the recording heads 24. The head driver 509 selects the driving pulse based on image data input into a serial port corresponding to a single line for the recording heads 24. By selecting the drive pulse included in the drive signal as described above, dots having different sizes can be formed by large-, middle-, and small-sized ink droplets.

An I/O unit 513 acquires data from a group of sensors attached to the image forming apparatus 1 to extract data required to control the image forming apparatus 1. Specifically, the data extracted by the I/O unit 513 is used for controlling the print controller 508, the motor driver 510, and the AC bias supplier 511. Specific examples of the group of sensors described above include, but are not limited to, an optical sensor configured to detect a position of the sheet P, a temperature sensor 515 such as a thermistor configured to monitor temperature inside the image forming apparatus 1, a sensor configured to monitor a charging voltage, an interlock switch configured to detect opening/closing motions of covers provided on the image forming apparatus 1, and the filler detector 305 configured to detect the position of the detection filler 205 of the sub tank 25. The I/O unit 513 processes data on the group of sensors described above.

The control unit 500 further includes a scanner controller 516 configured to control the image reading unit 2.

Figure 10:
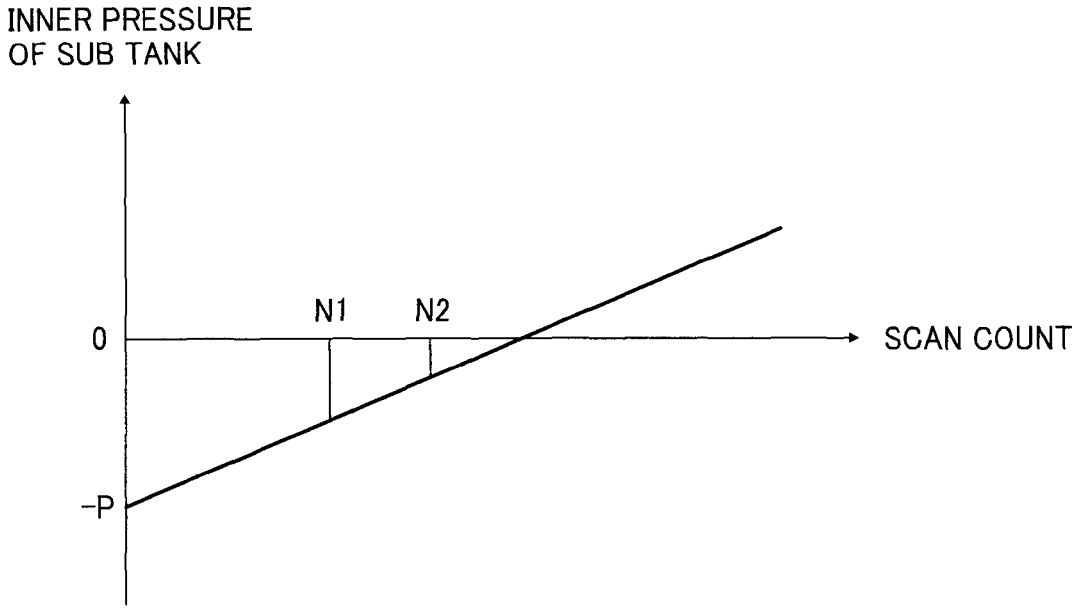
FIG. 10 is a graph illustrating an example of a relation between a scan count and pressure inside the sub tank according to the first illustrative embodiment.
Figure 11:
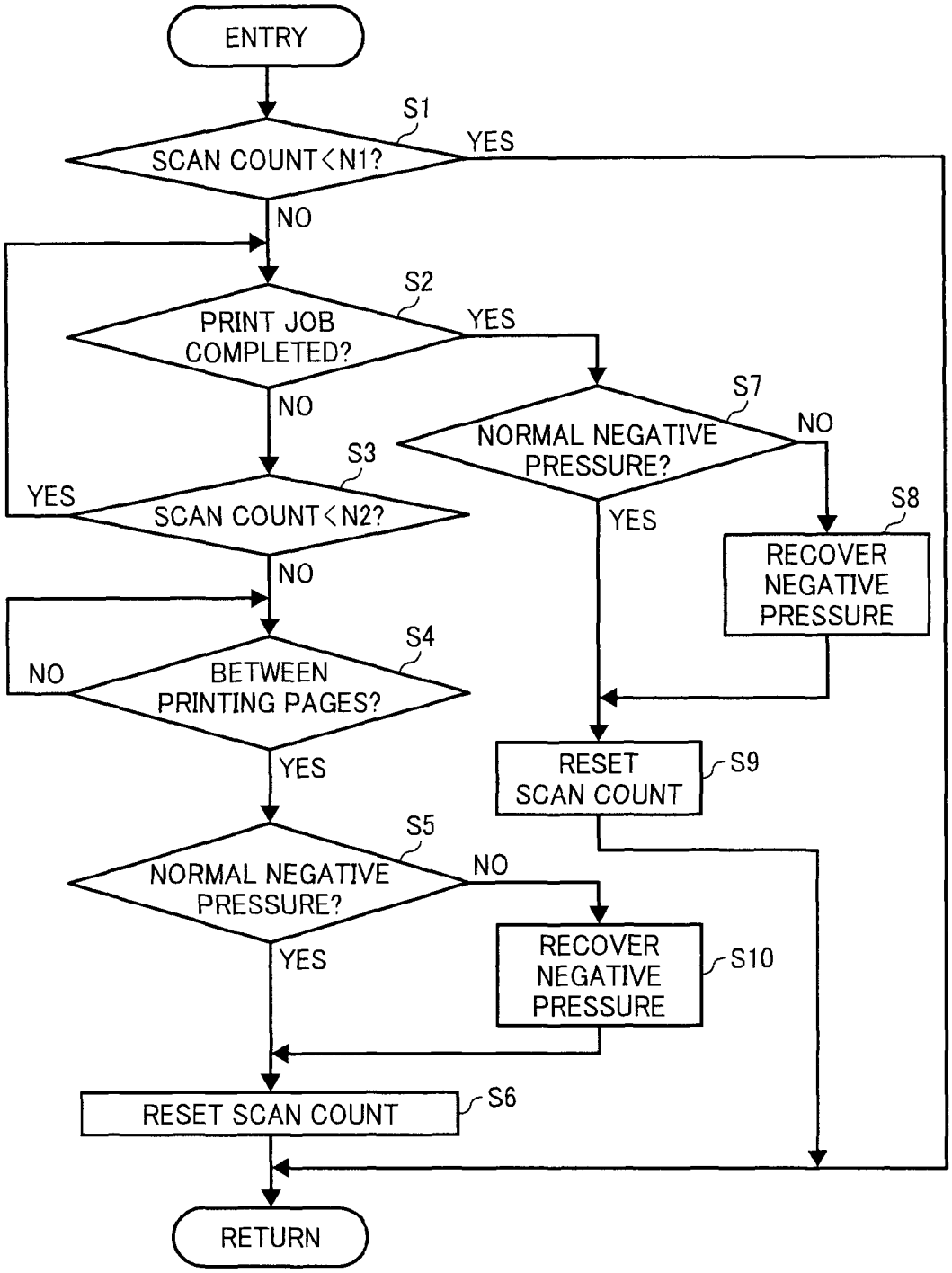
FIG. 11 is a flow chart illustrating a process of detecting and recovering a state of the negative pressure in the sub tank performed by the control unit.

A description is now given of the first illustrative embodiment of the present invention with reference to FIGS. 10 and 11. FIG. 10 is a graph illustrating an example of a relation between a scan count N of the carriage 23 and an inner pressure P inside the sub tank 25 according to the first illustrative embodiment. Here, each of outward and homeward scanning movements of the carriage 23 is counted as a single scan count N. When the inner pressure P is negative, it means that negative pressure is generated in the sub tank 25. FIG. 11 is a flow chart illustrating a process of detecting and recovering the state of the negative pressure in the sub tank performed by the control unit 500.

First, problems to be solved are described in detail below.

As noted previously, when the supply pump 28 is not tightly sealed during the scanning movement of the carriage 23, the ink is inadvertently supplied to the sub tank 25 from the ink cartridge 26 due to movement of the supply tube 27 along with the scanning movement of the carriage 23. Consequently, as illustrated in FIG. 10, it is confirmed that the inner pressure P of the sub tank 25 increases as the scan count N increases.

To solve such a problem, the inner pressure P of the sub tank 25 is detected when the scan count N of the carriage 23 reaches either a first predetermined scan count N1 or a second predetermined scan count N2 which is greater than the first predetermined scan count N1. When the inner pressure P of the sub tank 25 thus detected is not normal negative pressure (negative pressure in the normal state), the inner pressure P of the sub tank 25 is returned to normal negative pressure. Specifically, the inner pressure P of the sub tank 25 is returned to negative pressure in the normal state before positive pressure is generated in the sub tank 25, thereby preventing ink leakage from the multiple nozzles 31 of the recording heads 24.

In other words, the pressure inside the sub tank 25 is not in a normal state when the inner pressure of the sub tank 25 approaches a positive value, more specifically, when the inner pressure of the sub tank 25 exceeds a predetermined value. Therefore, determination of whether or not the pressure in the sub tank 25 is normal, that is to say sufficiently negative, means determining whether or not the inner pressure of the sub tank 25 exceeds that predetermined value.

A process of detecting and recovering the state of the negative pressure in the sub tank is described in detail below.

Referring to FIG. 11, at S1, the control unit 500 determines whether or not the scan count N of the carriage 23 reaches the first predetermined scan count N1. When the scan count N of the carriage 23 exceeds the first predetermined scan count N1 (No at S1), at S2, the control unit 500 determines whether or not the print job is completed. When the print job is completed (Yes at S2), at S7, the control unit 500 moves the carriage 23 to detect the detection filler 205 of the sub tank 25 using the filler detector 305 and determines whether or not the negative pressure in the sub tank 25 is in the normal state. When the negative pressure in the sub tank 25 is in the normal state (Yes at S7), at S9, the control unit 500 resets the scan count N. By contrast, when the negative pressure in the sub tank 25 is not in the normal state (No at S7), at S8, the control unit 500 returns the negative pressure in the sub tank 25 to the normal state. Thereafter, at S9, the control unit 500 resets the scan count N.

To return the negative pressure in the sub tank 25 to the normal state, the suction cap 41*a* caps the nozzle surface 31*a* of the recording head 24 of the relevant sub tank 25, and the suction pump 46 driven by the maintenance/recovery motor 47 sucks up the ink from the multiple nozzles 31. Accordingly, the ink is supplied from the sub tank 25 to the recording head 24, the amount of ink in the sub tank 25 decreases, and the negative pressure in the sub tank 25 is returned to the normal state. Alternatively, the recording head 24 idles to discharge ink droplets not used for image formation in order to supply ink from the sub tank 25 to the recording head 24, so that the amount of ink in the sub tank 25 is decreased and the pressure in the sub tank 25 is returned to its normal negative state.

When the scan count N of the carriage 23 exceeds the first predetermined scan count N1 (No at S1) and the print job is not completed (No at S2), at S3, the control unit 500 determines whether or not the scan count N of the carriage 23 exceeds the second predetermined scan count N2. When the scan count N of the carriage 23 does not exceed the second predetermined scan count N2 (Yes at S3), the process returns to S2.

By contrast, when the scan count N of the carriage 23 exceeds the second predetermined scan count N2 (No at S3), at S4, the control unit 500 determines whether the carriage 23 is not in operation between print pages. When the carriage 23 is not in operation between the print pages (Yes at S4), at S5, the control unit 500 moves the carriage 23 so that the filler detector 305 detects the detection filler 205 of the sub tank 25 to determine whether or not the negative pressure in the sub tank 25 is in the normal state. When the negative pressure in the sub tank 25 is in the normal state (Yes at S5), at S6, the control unit 500 resets the scan count N. By contrast, when the negative pressure in the sub tank 25 is not in the normal state (No at S5), at S10, the control unit 500 returns the negative pressure in the sub tank 25 to the normal state. Thereafter, at S6, the control unit 500 resets the scan count N.

As described above, in the image forming apparatus 1 according to illustrative embodiments, the state of the negative pressure in the sub tank 25 is detected by the negative pressure detector when the scan count N of the carriage 23 reaches the predetermined scan counts. Because the negative pressure in the sub tank 25 is returned to the normal state when the negative pressure thus detected is not in the normal state, ink leakage from the multiple nozzles 31 of the recording heads 24 due to the undesirable state of the negative pressure caused by the inadvertent supply of the ink to the sub tank 25 can be prevented without substantially decreasing print speed even when the state of the negative pressure in the sub tank 25 cannot be detected during the scanning movement of the carriage 23.

The above-described configuration makes it possible to detect the state of the negative pressure in the sub tank 25 at completion of the print job when the scan count N reaches the first predetermined scan count N1. As a result, ink leakage from the multiple nozzles 31 of the recording heads 24 can be prevented without decreasing the print speed. Further, when the scan count N of the carriage 23 reaches the second predetermined scan count N2, the state of the negative pressure in the sub tank 25 is detected while the carriage 23 is not in operation between the print pages. As a result, ink leakage from the multiple nozzles 31 of the recording heads 24 can be immediately prevented without waiting for the completion of the print job.

Specifically, when the scan count N of the carriage 23 reaches the first predetermined scan count N, the state of the negative pressure in the sub tank 25 is detected at the completion of the print job. When the scan count N of the carriage 23 reaches the second predetermined scan count N2 which is greater than the first predetermined scan count N1, the state of the negative pressure in the sub tank 25 is detected while the carriage 23 is not in operation between the print pages. More specifically, the negative pressure in the sub tank 25 is returned to the normal state while the carriage 23 is not in operation between the print pages in a case in which prompt recovery of the negative pressure in the sub tank 25 to the normal state is required. By contrast, in a case in which prompt recovery of the negative pressure in the sub tank 25 is not required, the negative pressure in the sub tank 25 is returned to the normal state after the print job is completed. As a result, ink leakage from the multiple nozzles 31 of the recording heads 24 can be reliably prevented without decreasing the print speed.

Figure 12:
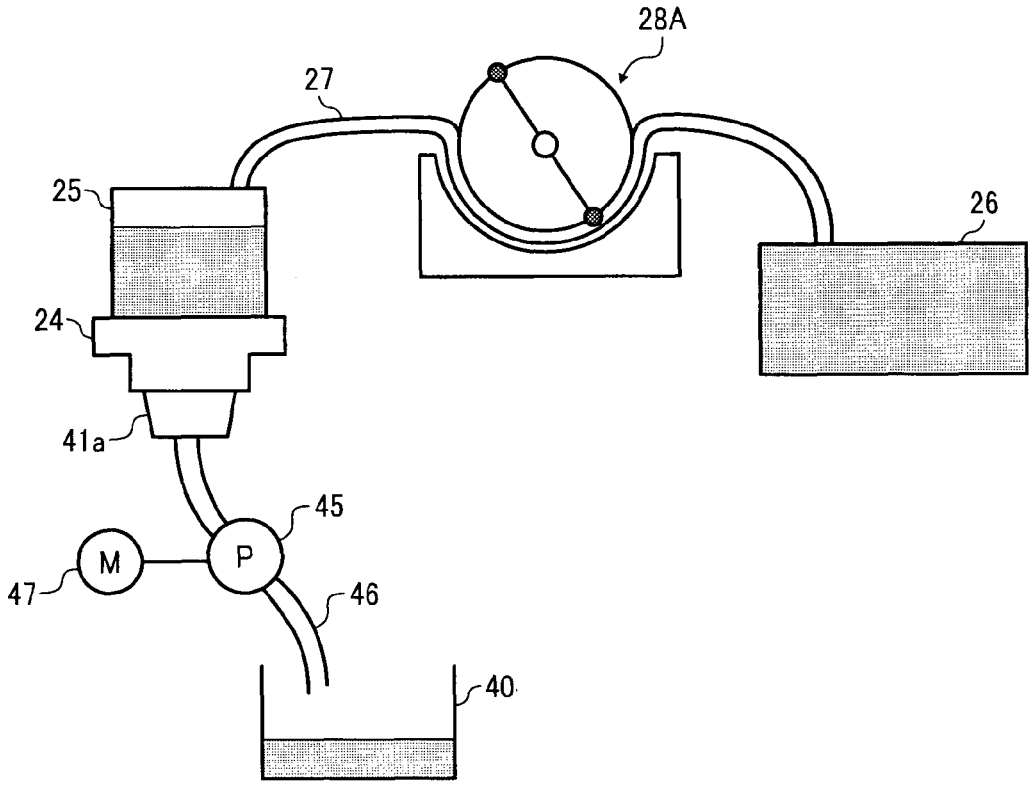
FIG. 12 is a schematic view illustrating an ink supply system and a maintenance/recovery system of the image forming apparatus according to a second illustrative embodiment.

A description is now given of a second illustrative embodiment of the present invention with reference to FIG. 12. FIG. 12 is a schematic view illustrating an ink supply system and a maintenance/recovery system of the image forming apparatus 1 according to the second illustrative embodiment.

Referring to FIG. 12, a tube pump 28A serving as a supply pump configured to supply the ink in both directions is provided between the ink cartridge 26 and the sub tank 25.

The above-described configuration makes it possible to rotate the tube pump 28A in reverse to return the ink from the sub tank 25 to the ink cartridge 26 in order to recover the negative pressure in the sub tank 25 to the normal state. As a result, the amount of ink in the sub tank 25 is decreased, thereby returning the negative pressure in the sub tank 25 to the normal state.

As described above, alternatively, the recording head 24 may idle to discharge the ink droplets not used for image formation in order to supply the ink from the sub tank 25 to the recording head 24 so that the amount of the ink in the sub tank 25 is decreased and the negative pressure in the sub tank 25 is recovered to the normal state.

Figure 13:
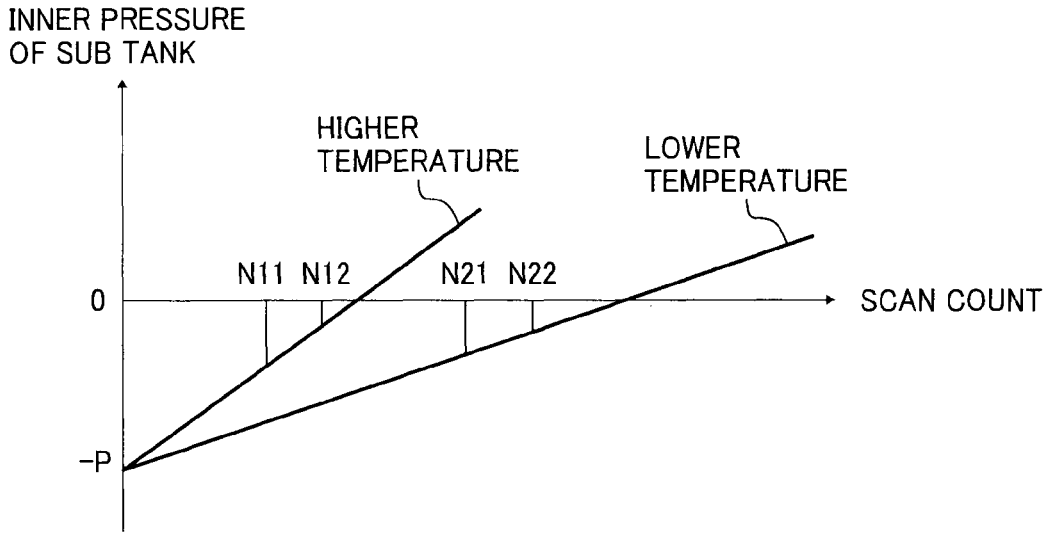
FIG. 13 is a graph explaining how to set predetermined scan counts under different temperature conditions.

A description is now given of a third illustrative embodiment of the present invention with reference to FIG. 13. FIG. 13 is a graph explaining how to set the predetermined scan counts under different temperature conditions.

With ink of reduced viscosity, the ink tends to be inadvertently supplied from the ink cartridge 26 to the sub tank 25 due to the scanning movement of the carriage 23. As a result, because the amount of ink inadvertently supplied from the ink cartridge 26 to the sub tank 25 changes depending on ambient temperature, the inner pressure P inside the sub tank 25 also changes depending on ambient temperature as illustrated in FIG. 13.

When a temperature is higher than a temperature T1 (hereinafter referred to as a higher temperature), a first predetermined scan count N11 and a second predetermined scan count N12 are set to be compared with the scan count N of the carriage 23. By contrast, when a temperature is lower than the temperature T1 (hereinafter referred to as a lower temperature), a different first predetermined scan count N21 and a different second predetermined scan count N22 are set to be compared with the scan count N of the carriage 23. The control unit 500 determines whether or not the temperature detected by the temperature sensor 515 is higher than the temperature T1. When the temperature thus detected is higher than the temperature T1, the scan count N is compared with the first predetermined scan count N11 and the second predetermined scan count N12 in a similar manner as illustrated in FIG. 11. By contrast, when the temperature thus detected is lower than the temperature T1, the scan count N is compared with the different first and second predetermined scan counts N21 and N22.

As described above, different predetermined scan counts are set depending on the temperature, thereby reliably preventing ink leakage from the multiple nozzles 31 of the recording heads 24 without decreasing the print speed.

As can be appreciated by those skilled in the art, numerous additional modifications and variations are possible in light of the above teachings. It is therefore to be understood that within the scope of the appended claims, the disclosure of this patent specification may be practiced otherwise than as specifically described herein. For example, elements and/or features of different illustrative embodiments may be combined with each other and/or substituted for each other within the scope of this disclosure and appended claims.

This patent specification is based on Japanese Patent Application No. 2007-294992 filed on Nov. 14, 2007 in the Japan Patent Office, the entire contents of which are hereby incorporated herein by reference.

What is claimed is:

1. An image forming apparatus, comprising:

a carriage configured to movably scan, comprising;

a recording head configured to discharge ink droplets; and a sub tank configured to supply ink to the recording head;

a main tank configured to supply the ink to the sub tank via a tube;

a negative pressure detector configured to detect a state of a negative pressure in the sub tank when the sub tank is at a predetermined position;

a count unit configured to count a number of scans conducted by the carriage; and a control unit configured to cause the negative pressure detector to detect the state of the negative pressure in the sub tank to return the negative pressure in the sub tank to a normal state based on a detection result obtained by the negative pressure detector when the number of scans carried out by the carriage as counted by the count unit reaches a predetermined scan count.

2. The image forming apparatus according to claim 1, wherein the negative pressure detector detects the state of the negative pressure in the sub tank after a print job is completed.

3. The image forming apparatus according to claim 1, wherein the negative pressure detector detects the state of the negative pressure in the sub tank when the carriage is not in operation between print pages of a print job.

4. The image forming apparatus according to claim 1, wherein the negative pressure detector detects the state of the negative pressure in the sub tank after completion of a print job when the number of scans reaches a first predetermined scan count, and detects the state of the negative pressure in the sub tank while the carriage is not in operation between the print pages of a print job when the number of scans reaches a second predetermined scan count greater than the first predetermined scan count.

5. The image forming apparatus according to claim 1, wherein the negative pressure detector comprises a movable negative pressure detector configured to move based on the state of the negative pressure in the sub tank, and the negative pressure detector detects the state of the negative pressure in the sub tank based on a position of the movable negative pressure detector.

* * * * *